US006816686B2

(12) United States Patent
Hooper et al.

(10) Patent No.: US 6,816,686 B2
(45) Date of Patent: Nov. 9, 2004

(54) ELECTROPHOTOGRAPHIC IMAGING AND FUSING APPARATUS AND METHODS

(75) Inventors: Howard G. Hooper, Boise, ID (US); Eric Unger Eskey, Meridian, ID (US); Julie Jensen, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/374,478

(22) Filed: Feb. 25, 2003

(65) Prior Publication Data

US 2004/0165897 A1 Aug. 26, 2004

(51) Int. Cl.[7] ..... G03G 15/20

(52) U.S. Cl. ..... 399/44; 399/45; 399/68; 399/69

(58) Field of Search ..... 399/44, 46, 67, 399/68, 69, 45; 219/216

(56) References Cited

U.S. PATENT DOCUMENTS

| | | | |
|---|---|---|---|
| 4,319,874 | A | 3/1982 | Sawano |
| 4,822,977 | A | 4/1989 | Leising et al. |
| 5,138,178 | A | 8/1992 | Wong et al. |
| 5,170,215 | A | 12/1992 | Pfeuffer |
| 5,406,363 | A | 4/1995 | Siegel et al. |
| 6,088,547 | A | 7/2000 | Martin et al. |
| 6,243,545 | B1 | 6/2001 | Jewell |

FOREIGN PATENT DOCUMENTS

JP 11-174891 * 7/1999

* cited by examiner

*Primary Examiner*—Quana M. Grainger

(57) ABSTRACT

Electrophotographic imaging methods include providing a fusing device operationally characterized by a fusing speed, a fusing temperature, and a fusing pressure. The fusing speed is controlled as a function of the fusing temperature, while the fusing pressure is controlled as a function of the fusing speed, and the fusing temperature is controlled as a function of the fusing speed and the fusing pressure.

23 Claims, 4 Drawing Sheets

300

1) $V_f = V_r \left\{ \frac{A}{1-[a(GM_r - GM) + b(TD_r - TD) + d(C_r - C)]} \right\} + V_r \left\{ \frac{B}{1 - T_{fc} - T_{fm}} \right\}$ 310

2) $P_f = P_r \left\{ \frac{H}{1-[k(GM_r - GM) + l(TD_r - TD) + m(C_r - C) + n(R_r - R) + o(V_r - V_f)]} \right\} - p(T_{fm} - T_{fc})$ 320

3) $T_{fc} = T_r \left\{ \frac{D}{1-[e(GM_r - GM) + f(R_r - R) + g(TD_r - TD) + h(C_r - C)]} \right\} - E(V_r - V_f) - T_r \left\{ \frac{F}{1-[i(P_f - P_r) + j(T_{fm} - T_r)]} \right\}$ 330

FIG. 3

ELECTROPHOTOGRAPHIC IMAGING AND FUSING APPARATUS AND METHODS

BACKGROUND OF THE INVENTION

Electrophotographic imaging apparatus and methods are well known in the art. Coriventional electrophotographic imaging apparatus, often called "printers," typically include, among other components, an image forming device, a fusing device ("fuser"), a toner applicator, and media conveyance system. The image-forming device typically includes both a photoconductive surface and a selectively controllable light source. The light source typically includes either an array of light emitting diodes, or a laser and associated laser scanning mechanism. The photoconductive surface is generally in the form of either an endless rotatable drum, or an endless circulatable belt.

During operation of conventional imaging apparatus, the photoconductive surface is generally rotated or circulated so as to continually move relative to the light source. The light source is directed at the photoconductive surface and is capable of selectively exposing predetermined areas of the photoconductive surface on a pixel-by-pixel basis. That is, as the photoconductive surface moves relative to the light source, the light source is selectively pulsed in accordance with predetermined data. This selective exposure of the photoconductive surface to the light source results in the formation of a latent electrostatic image on the photoconductive surface.

After the latent electrostatic image is formed on the photoconductive surface, the toner applicator applies one or more toners to the photoconductive surface to form a visible image. In a "black-and-white" printer, only black toner is generally applied to the photoconductive surface, while in "color" printers, one or more different colors of toner is applied. The visible image is then transferred from the photoconductive surface to a carrier media such as a sheet of paper or the like.

After receiving the toner from the photoconductive surface, the media is then moved and guided by the media conveyance system to the fusing device. The fusing device typically includes a "hot roller" and an associated pressure roller that are oriented relative to one another so as to form a nip point there between. The hot roller typically includes a heating element that is generally controlled so as to maintain a substantially constant temperature. After receiving the toner in the form of an image, the sheet of media is passed through the nip point between the rollers of the fixing device, whereby the media and the toner thereon are heated so as to bond, or "fix," the toner to the media. The hot roller and pressure roller generally rotate at a substantially constant rotational speed.

The amount of heat transferred to the media and toner supported thereon during the image fixing process is generally known to be relatively critical. That is, if too much heat is applied to the media during the image fixing process, the media can become curled as a result. On the other hand, if not enough heat is transferred to the media during the image fixing process, the toner is not completely bonded to the media and thus can become easily smeared, and/or can peel off of the media.

As mentioned above, typical prior art fixing devices are often equipped with a temperature control system that is configured to substantially maintain the temperature of the hot roller at a set, predetermined level. Such temperature control systems typically include a temperature sensor and a control system. The temperature sensor is configured to detect the temperature of the hot roller and/or the pressure roller, and the control system is configured to adjust the amount of energy supplied to the heating element within the hot roller in response to the temperature detected by the temperature sensor.

For example, if the temperature of the hot roller and/or the pressure roller is detected by the sensor to be below the set temperature point, then the control system increases -the amount of energy supplied to the heating element in an attempt to increase the temperature of the hot roller so as to approach the set point. Conversely, if the temperature of the hot roller and/or the pressure roller is detected by the sensor to be above the set temperature point, then the control system decreases or shuts off, the energy supplied to the heating element in an attempt to decrease the temperature of the hot roller accordingly. The temperature set point is generally determined to provide the best overall fuser performance over a given range of possible variable conditions. Such conditions include media surface roughness, media temperature, media thickness, and media moisture content, as well as ambient environmental conditions.

SUMMARY OF THE INVENTION

In accordance with various embodiments of the present invention, a method for controlling the operation of a fusing device in an electrophotbgraphic imaging apparatus includes providing a fusing device, the operation of which is characterized by a fusing temperature, a fusing speed, and a fusing pressure. The method can include controlling the fusing speed as a function of the fusing temperature, controlling the fusing pressure as a function of the fusing speed, and controlling the fusing temperature as a function of the fusing speed and the fusing pressure. An apparatus in accordance with at least one embodiment of the present invention can include at least one signal source that is configured to transmit associated data indicative of an operating parameter. The apparatus can also include a processor that is configured to receive the data transmitted from the signal source and to control the fusing speed as a function of the data. The processor can also be configured to control the fusing temperature as well as the fusing pressure as respective functions of the data.

DESCRIPTION OF THE DRAWINGS

FIG. 3 is a diagram depicting an example of a set of equations that can be employed in the method of controlling a fusing device depicted in FIG. 2.

DETAILED DESCRIPTION OF THE INVENTION

In accordance with various embodiments of the present invention, apparatus and methods for electrophotographically producing images are described herein, wherein the images are thermally affixed, or fused, to an image carrying media by way of a fusing device. The apparatus and methods in accordance with various embodiments of the present invention generally concern the operation and/or control of fusing devices in conjunction with the electrophotographic production of images.

Figure 1:
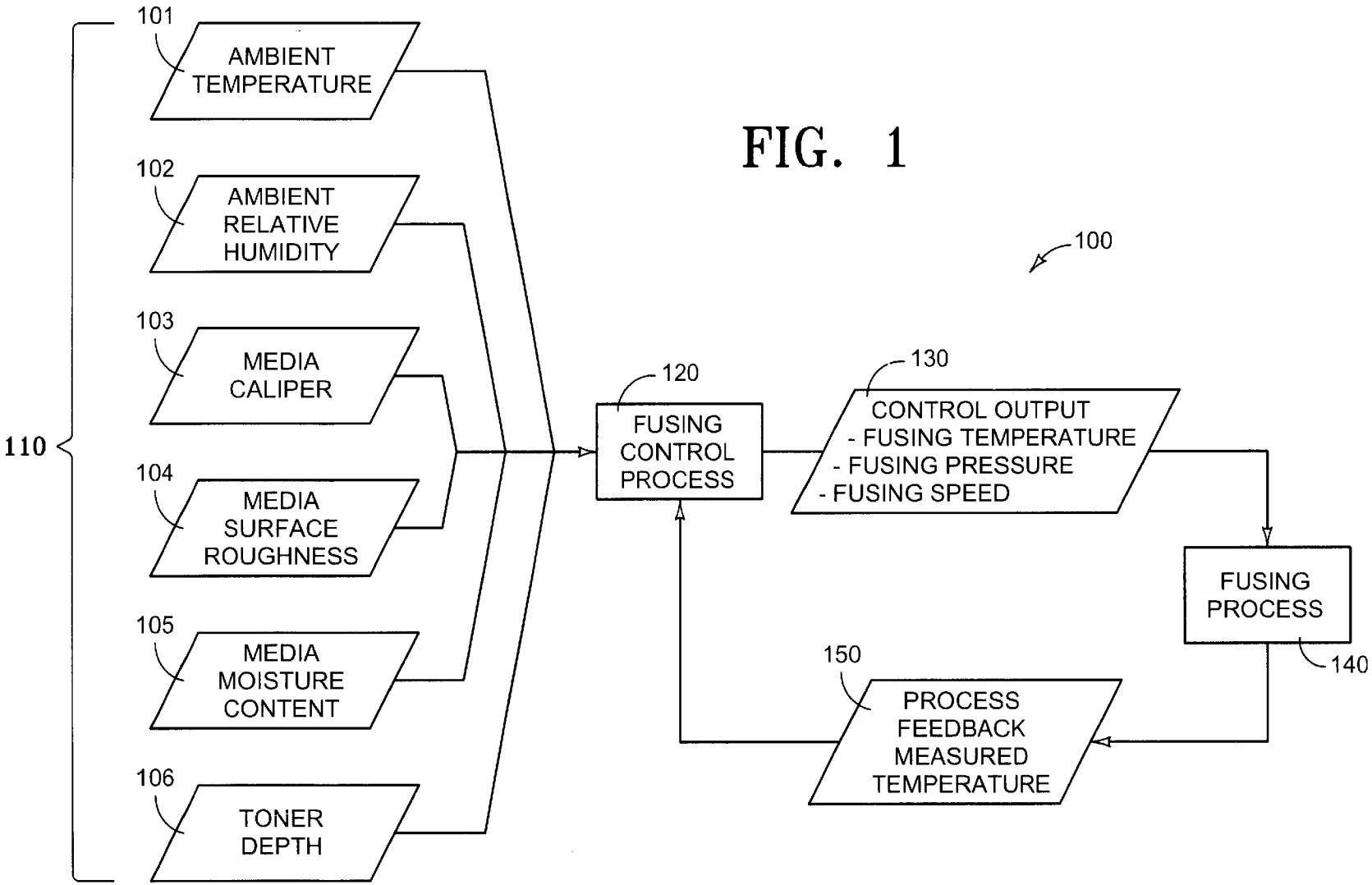
FIG. 1 is a schematic control diagram depicting a control process for an electrophotographic imaging apparatus that includes a fusing device, in accordance with one embodiment of the present invention.

Turning now to FIG. 1, a flow diagram 100 is shown in which a simplified fusing control process is depicted in accordance with one embodiment of the present invention. The term "fusing," as used herein, refers to the well known thermal fixing process employed in conjunction with conventional electrophotographic production of images, wherein toner in the form of an image is thermally fixed, or fused, to a sheet of image carrying media. Thus, a fusing process for use in conjunction with an otherwise conventional electrophotographic imaging process is depicted in FIG. 1 in accordance with one embodiment of the present invention.

As is seen, a set 110 of one or more parameters can be input into a fusing control process 120. The fusing control process 120 is discussed in greater detail below. The set 110 of parameters can include any of a number of possible parameters that can be employed in the fusing control process 120. By way of example only, the set 110 of parameters can include one or more parameters such as ambient temperature 101, ambient relative humidity 102, media caliper (thickness) 103, media surface roughness 104, media moisture content 105, and toner depth 106.

Some of the set 110 of parameters can be measured by way of sensors or the like (not shown), while others of the set of parameters can be determined in other manners. For example, while parameters such as ambient temperature 101, ambient relative humidity 102, and other parameters, can be detected and measured by way of applicable sensors that are known in the art, the parameter media caliper 103 can be determined by operator input. That is, for example, an operator of an electrophotographic imaging device (not shown) can manually input (by way of a keypad, for example) the media caliper 103.

Alternatively, a media caliper-detecting device (not shown), of which various forms are known in the art, can be employed to automatically detect and measure the media caliper 103. As a further example, toner depth 106 can be automatically machine-generated. That is, conventional electrophotographic imaging apparatus are typically configured to receive image data from a host device or the like, wherein the image data is indicative of the image to be produced, and wherein such data is employed by the imaging apparatus to produce the desired image.

Such image data can include data that is indicative of the toner depth 106. Alternatively, image data not specifically including toner depth can be analyzed by an electrophotographic imaging apparatus in accordance with an electrophotographic imaging process in order to predict the toner depth 106. In this manner, the toner depth 106 can be said to be automatically machine-generated.

The fusing control process 120 (briefly mentioned above) can be a process in accordance with which one or more input parameters, such as the set 110 of parameters, can be analyzed or otherwise processed in order to develop one or more output control data. For example, the control process 120 can be configured to employ the set 110 of parameters to produce control output 130. The control output 130 consists of control data that can be employed to control the fusing process 140.

As is seen, the control output 130 can include, by way of example only, fusing temperature and/or fusing pressure and/or fusing speed. That is, as is discussed above, conventional electrophotographic imaging apparatus typically include a fusing device that is configured to thermally fix, or fuse, images in the form of toner to an image carrying sheet of media, such as a sheet of paper or the like. Electrophotographic imaging apparatus, as well as conventional fusing devices, and their operation, are well known in the art and need not be discussed in detail.

Conventional fusing devices are typically capable of operating at a given fusing temperature and/or a given fusing speed and/or a given fusing pressure. More specifically, as is discussed above with respect to the prior art, typical fusing devices consist of a hot roller and a pressure roller that together form a nip point into which the media and image to be fused are fed. Thus, typical fusing devices include a hot roller and a pressure roller, wherein the hot roller can be maintained at a given fusing temperature and/or can be rotated at a given fusing speed, and wherein the pressure roller can press against the image and media, and/or the hot roller, at a given fusing pressure.

As is depicted in FIG. 1, the control output 130, which can consist of the fusing temperature and/or the fusing pressure and/or the fusing speed, can be determined in accordance with one or more of the set 110 of parameters. That is, the control output 130 can be a function of the set 110 of parameters. In other words, one or more of the set 110 of parameters can be input into the fusing control process 120, wherein various analytical operations can be performed on the set of parameters to result in the control output 130.

The control output 130 can be in the form of data signals and/or control signals that can be transmitted to a fusing device (not shown), wherein such a fusing device can be operated in accordance with a fusing process. That is, such a fusing device can be configured to receive the control output 130 which can be in the form of data signals and/or control signals, and which can be transmitted as a result of the fusing control process 120. Thus, a conventional fusing device can be operated in accordance with the fusing process 140, which in turn, can be controlled in accordance with the fusing control process 120.

As is further depicted in FIG. 1, process feedback 150 can be generated in accordance the fusing process 140. The process feedback 150 can consist of data that can be input into the fusing control process 120. That is, the fusing control process 120 can employ the process feedback 150, in addition to the set 110 of parameters, to determine the control output 130. In other words, the control output 130 can be a function of the process feedback 150.

By way of example only, the process feedback 150 can be measured fusing temperature. That is, conventional fusing devices often include temperature sensors that are employed to detect substantially the actual temperature of the hot roller. The actual temperature of the hot roller, as measured by such a temperature sensor, is oftentimes different than the fusing temperature of the control output 130 as generated by the fusing control process.

This can be caused, as is known in the art, by the variance in the rate of heat transfer from the hot roller to its surrounding environment, and/or to the media. That is, the rate of heat transfer from the hot roller to the surrounding environment can vary greatly depending on a number of factors, including ambient conditions. Thus, the term "measured temperature," as used herein refers to a given temperature that is detected and/or measured in conjunction with the fusing process, wherein the given temperature is indicative of apportion of a fusing device that is operated in accordance with the fusing process 140.

Figure 2:
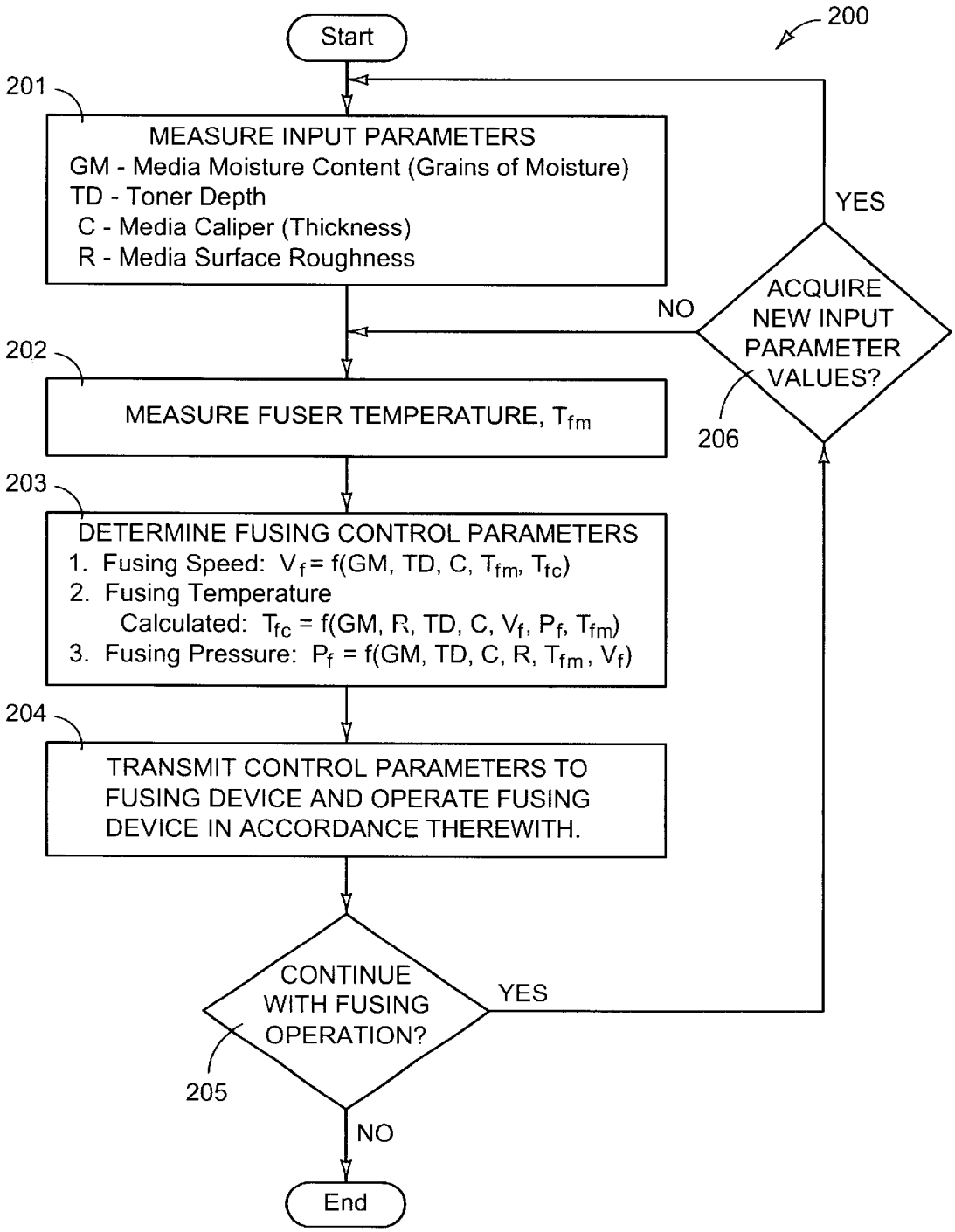
FIG. 2 is a flow diagram depicting a more detailed method of controlling a fusing device in accordance with another embodiment of the present invention.

Turning now to FIG. 2, a more detailed flow diagram 200 is depicted in accordance with another embodiment of the present invention. The flow diagram 200 includes a number of steps in accordance with which a fusing process can be controlled. A first step 201 can consist of assembling a set of input parameters, GM, TD, C, and R. As is indicated, GM represents media moisture content, TD represents toner depth, C represents media caliper, and R represents media surface roughness. Any of the input parameters GM, TD, C, and R can be developed in any of a number of possible manners such as by machine generation, detection, measurement, and/or operator input, for example.

In accordance with the next step 202, the fuser temperature, measured $T_{fm}$, can be determined. A more detailed discussion of the fuser temperature, measured $T_{fm}$, is provided below. In accordance with the following step 203, one or more of the input parameters GM, TD, C, and R can be employed to determine one or more control output variables $V_f$, $T_{fc}$, and $P_f$, wherein $V_f$ represent fusing speed, $T_{fc}$ represents fusing temperature, calculated, and $P_f$ represents fusing pressure. That is, in accordance with step 203, three equations can be developed, wherein one of the equations represents fusing speed $V_f$, another of the equations represents fusing temperature, calculated $T_{fc}$, and yet another of the equations represents fusing pressure $P_f$.

More specifically, and by way of example only, fusing speed $V_f$ can be a function of one or more of media moisture content GM, toner depth TD, and media caliper C. Also, by way of example only, fusing temperature, calculated $T_{fc}$, can be a function of one or more of media moisture content GM, media surface roughness R, toner depth TD, and media caliper C. Similarly, by way of example only, fusing pressure can be a function of one or more of media moist ire content GM, toner depth TD, media caliper C, and media surface roughness R.

As is also seen from a study of FIG. 2, the fusing speed $V_f$ can, alternatively or additionally, be a function of fusing temperature, calculated $T_{fc}$, and/or fusing temperature, measured $T_{fm}$. Fusing temperature, measured $T_{fc}$, is explained in greater detail below. Similarly, a study of FIG. 2 reveals that fusing temperature, calculated $T_{fc}$, can, alternatively or additionally, be a function of fusing speed $V_f$ and/or fusing pressure $P_f$, and/or fusing temperature, measured $T_{fm}$.

In any case, the equations representing fusing speed $V_f$, fusing temperature, calculated $T_{fc}$, and fusing pressure $P_f$, can be solved in accordance with step 203. For example, in the specific illustrative example depicted in FIG. 2, wherein the equations for fusing speed $V_f$, fusing temperature, calculated $T_{fc}$, and fusing pressure $P_f$, are each represented by respective equations, those equations can be solved by way of known mathematical processes, such as by way of simultaneous solution.

When the fusing speed $V_f$, fusing temperature, calculated $T_{fc}$, and fusing pressure $P_f$ are determined in accordance with step 203, then a fusing process can be carried out at the fusing speed, fusing temperature, calculated, and fusing pressure in accordance with step 204. That is, a fusing device (not shown) can be provided, wherein the fusing device can be operated in accordance with step 204 at the fusing speed $V_f$, fusing temperature, calculated $T_{fc}$, and fusing pressure $P_f$ which can be determined in accordance with step 203 and can be transmitted to the fusing device.

The flow diagram 200 next moves to step 205 in accordance with which a decision is made. The decision of stop 205 queries whether the fusing operation should continue. If the answer to the query of step 205 is "no," then the fusing operation does not continue and the flow diagram 200 ends, as is shown. However, if the answer to the query of step 205 is "yes," then the fusing operation continues and the flow diagram 200 moves to step 206.

Step 206 of the flow diagram 200 is another query. The query of step 206 asks whether new input parameter values should be acquired. In other words, the query of step 206 asks whether the input parameters should be measured again, or updated. If the answer to the query of step 206 is "no," then the flow diagram 200 proceeds again to step 202, in accordance with which the fusing temperature, measured $T_{fm}$, is determined again. From step 202, the flow diagram 200 proceeds in the manner that is described above.

However, if the answer to the query of step 206 is "yes," then the flow diagram 200 proceeds to step 201 in accordance with which one or more of the input parameters GM, TD, C, and R are measured again as is described above. From step 201, the flow diagram proceeds to step 202 as is described above. Thus, in accordance with the flow diagram 200, the fuser temperature can be measured at a higher frequency than the measurement of one or more input parameters. Alternatively, the fuser temperature can be measured at substantially the same frequency as the input parameters are measured. That is, steps 201 and 202 can be performed at substantially the same frequency, or in the alternative, step 202 can be performed more often than step 202.

It is noted that in accordance with step 202, the temperature of the fusing device is measured, or otherwise determined. This measurement of the fusing device can be performed in any of a number of possible manners such as by measuring the temperature of the hot roller or by measuring the temperature of the pressure roller, or the like. In any case, the fusing temperature, measured $T_{fm}$, is determined in accordance with step 202. The fusing temperature, measured $T_{fm}$, can then be input into the fusing control process of step 203 as is depicted in FIG. 2. That is, the fusing temperature, measured $T_{fm}$, can be employed as process feedback as the process continues to be performed.

It is understood that the terms "fusing temperature, calculated" and "fusing temperature, measured" are used herein to distinguish the fusing temperature output as determined in accordance with step 203 from the actual fusing temperature as determined in accordance with step 202. That is, the fusing temperature, calculated $T_{fc}$, is generally an output value of the fusing control process of step 203, while the fusing temperature, measured $T_{fm}$, is generally an input value of the step 203. It is further understood that the generalized term "fusing temperature" as used herein is intended to denote fusing temperature, calculated $T_{fc}$, and/or fusing temperature, measured $T_{fm}$.

Still referring to FIG. 2, it is seen that the control process represented by the flow diagram 200 can be employed to control a fusing process in conjunction with an electrophotographic imaging process. Moreover, the control process represented by the diagram 200 can be employed to substantially continually adjust, or control, one or more operational parameters such as fusing speed $V_f$, fusing temperature, calculated $T_{fc}$, and/or fusing pressure $P_f$, as a function of one or more input parameters such as media moisture content GM, toner depth TD, media caliper C, media surface roughness R, and/or fusing temperature, measured $T_{fm}$.

Furthermore, the fusing speed $V_f$ can be controlled as a function of fusing temperature, measured $T_{fm}$ and/or fusing temperature, calculated $T_{fc}$. Similarly, fusing temperature, calculated $T_{fc}$, can be controlled as a function of fusing speed $V_f$, and/or fusing temperature, measured $T_{fm}$ and/or fusing pressure $P_f$. Likewise, fusing pressure $P_f$ can be controlled as a function of fusing temperature, measured $T_{fm}$, and/or fusing speed $V_f$.

It is understood that the fusing process operating parameters, such as fusing speed $V_f$, fusing temperature, calculated $T_{fc}$, and/or fusing pressure $P_f$, can be updated, or adjusted, at intervals or substantially continuously. That is, rather than substantially continuously controlling the fusing speed $V_f$, fusing temperature, calculated $T_{fc}$, and/or fusing pressure $P_f$ in accordance with the control process as is illustrated by the diagram 200, those operational parameters can be periodically determined in conjunction with the occurrence of an event.

For example, such an event can be the passage, or expiration, of a given period of time as measured by a timer (not shown) or the like. Such an event can alternatively be an event that occurs randomly, or that does not occur at regular intervals of time. In any case, it is understood that the steps 201, 202, 203, 204, 205 and 206 can be performed at intervals rather than substantially continuously, wherein the intervals can be regular intervals, or random, irregular intervals.

Such random or irregular intervals can be defined, for example, by an event which can include, for example, the start-up of an electrophotographic imaging device, or the commencement of an imaging job. Thus, it is understood that the control process illustrated by the flow diagram 200 can be performed at regular intervals as determined by a timer or clock (not shown), or alternatively, the control process can be performed in association with a given event, regardless of elapsed time, wherein such an event can be, for example, the commencement of a print job, or the warm-up cycle of an electrophotographic imaging apparatus.

Turning now to FIG. 3, an illustrative example of a set of mathematical equations 300 is depicted. The first equation 310 can be representative of the fusing speed $V_f$. Similarly, the second equation 320 can be representative of the fusing pressure $P_f$. Likewise, the third equation 330 can be representative of the fusing temperature, calculated $T_{fc}$.

It is noted that $GM_r$ can be a reference value (as denoted by the subscript "r") associated with the media moisture content input parameter GM. That is, the reference value $GM_r$ can be a constant value that can be employed as depicted in the equations 310, 320, and 330 to establish a relative value of the variable media moisture content parameter GM.

Thus, the term ($GM_r$—GM) can be the difference between the media moisture content input parameter GM and its respective associated reference value $GM_r$. Likewise, the reference value $TD_r$ and the reference value $C_r$ can be similarly employed with regard to the toner depth TD and the media caliper C, respectively. Similarly, the constants $R_r$, $V_r$, $P_r$, and $T_r$ can be reference values associated with media surface roughness, fusing speed, fusing pressure, and fusing temperature, respectively.

It is also seen that the set of equations 300 contain weighting factors a, b, c, d, e, f, g, h, i, j, k, l, m, n, o, as well as A, B, C, D, E, and F. These weighting factors can be constants that are determined in accordance with specific system criteria. Such specific system criteria can include, for example, the specific type of hardware employed to perform the fusing process and/or the specific type of environment in which the fusing process is performed.

Still referring to FIG. 3, it is seen that the fusing speed $V_f$, in accordance with the equation 310, can be a function of the media moisture content GM, the toner depth TD, the media caliper C, the fusing temperature, calculated $T_{fc}$, and the fusing temperature, measured $T_{fm}$. That is, any change in any of the variable parameters of the equation 300, which variable parameters include the media moisture content GM, the toner density TD, the media caliper C, the fusing temperature, calculated $T_{fc}$, and/or the fusing temperature, measured $T_{fm}$, can result in a corresponding change in the fusing speed $V_f$.

In this manner the fusing speed $V_f$ can be determined in response to one or more conditions that have the propensity to effect the fusing process. That is, the fusing speed $V_f$ can be determined in accordance with an equation such as the equation 310, wherein the fusing speed is changed, or varied, to compensate for changes in one or more variable parameters that can effect the fusing process. Similar equations or the like can be developed in the manner of the equation 300 for other fusing process operating parameters such as the fusing pressure $P_f$ and the fusing temperature, calculated $T_{fc}$.

Similarly, it is seen that the fusing pressure $P_f$, in accordance with the equation 320, can be a function of the media moisture content GM, the toner depth TD, the media caliper C, the media surface roughness R, the fusing speed V, and the fusing temperature T. Likewise, it is also seen that the fusing temperature, calculated $T_{fc}$, can be a function of the media moisture content GM, the media surface roughness R, the toner depth TD, the media caliper C, the fusing pressure P, and the fusing temperature T.

As is discussed above, it is understood that the input values can be "plugged into" the set of equations 300, while appropriate values for the constants are also substituted into the set of equations. Thus, the only variables to be determined can be the fusing speed $V_f$ fusing pressure $P_f$ and the fusing temperature, calculated $T_{fc}$. Because there are three equations, 310, 320, 330, and because there are three variables $V_f$, $P_f$, and $T_{fc}$, then the three variables can be determined by any of a number of known methods such as simultaneous solution of the three equations. Such solutions can be performed automatically by known means such as by employing a processor such as a programmable processor chip or programmable logic computer or the like.

Figure 4:
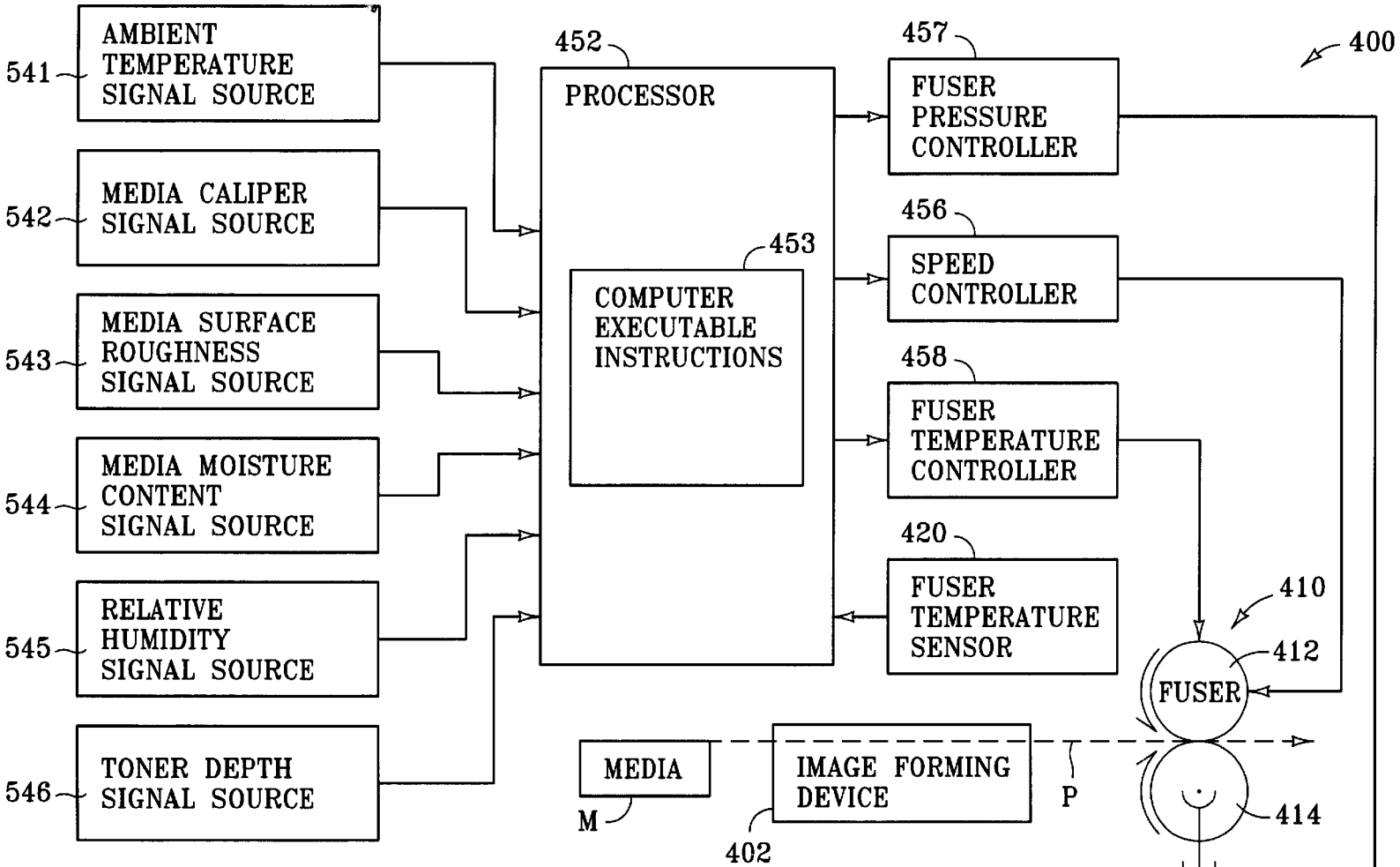
FIG. 4 is a schematic diagram of an imaging apparatus that includes a fusing device in accordance with yet another embodiment of the present invention.

Turning now to FIG. 4, a schematic diagram is shown in which a fusing apparatus 400 is shown in accordance with another embodiment of the present invention. The apparatus 400 includes a fuser, or fusing device, 410. The fuser 410 can include a pair of rollers 412 and 414. By way of example only, the roller 412 can be a hot roller that incorporates a heating element (not shown). Similarly, and by way of example only, the roller 414 can be a pressure roller. An actuator 416 can be included in the apparatus 400 as is depicted. The actuator 416 can be operatively connected to the fusing device 410, and more specifically, can be operatively connected to the roller 414.

In this manner, the actuator 416 can be configured to apply a force to the pressure roller 414, wherein the pressure roller is pressed against the hot roller 412. If a sheet of media M is between the rollers 412, 414, the sheet of media and an associated image supported thereon, can be forced against the roller 412 and/or the roller 414. Furthermore, the actuator 416 can be configured to vary the pressure with which the pressure roller 414 is forced against the hot roller, as is explained below in greater detail.

An image-forming device 402 can also be included in the apparatus 400. The image-forming device 402 can be, for example, an electrophotographic image-forming device in which toner is deposited onto a sheet of media M before the media is passed through the fusing device 410. That is, as is illustratively depicted in FIG. 4, the apparatus 400 can include an image-forming device 402 that is configured to deposit an image in the form of toner onto a sheet of media M that can be moved along a media path P.

After receiving the image in the form of toner, the sheet of media M can be moved along the media path P and through the fusing device 410. More specifically, the sheet of media M bearing the image in the form of toner can be moved along the media path P and between the hot roller 412 and the pressure roller 414.

As is further depicted in FIG. 4, the apparatus 400 can include a processor 452 that is configured to control the operational aspects of the fusing device 410. The processor 452 can also be configured to control other various operational aspects of the apparatus 400, such as the operation of the image-forming device 402.

The processor 452 can be of the general type that is known in the art. The processor 452 can contain a set of computer executable instructions 453 for carrying out various processing tasks as is explained in greater detail below. Computer executable instructions are generally known in the art and are widely employed in conjunction with processors such as the processor 452.

The processor 452 can be configured to receive one or more data signals from one or more associated signal sources which can include an ambient temperature signal source 541, a media caliper signal source 542, a media surface roughness signal source 543, a media moisture content signal source 544, a relative humidity signal source 545, and/or a toner depth signal source 546. Each of the signal sources 541, 542, 543, 544, 545, 546 can be in any of a number of possible forms including sensors, processors, computers, and/or data storage devices and the like.

As mentioned above, each of the signal sources 541, 542, 543, 544, 545, 546 can be configured to transmit to the processor 452 an associated signal that is indicative of a corresponding input parameter. For example, the ambient temperature signal source 541 can be configured to transmit to the processor 452 a signal that is indicative of the relative magnitude of the ambient temperature of the environment of the apparatus 400. By way of further example, the ambient temperature signal source 541 can include an ambient temperature sensor (not shown).

Likewise, for example, the media caliper signal source 542 can be configured to transmit to the processor 452 an associated signal that is indicative of the relative thickness of the media M. In such a case, the media caliper signal source 542 can include an operator interface (not shown) by which an operator can input data indicative of the media caliper, or thickness.

Alternatively, the media caliper signal source 542 can include an automatic media caliper detection device (not shown) or the like, which can automatically measure the media caliper in conjunction with the operation of the apparatus 400. It is understood that the remainder of the signal sources 543, 544, 545, 546 can be configured in similar manners.

The apparatus 400 can also include a fuser speed controller 456. The apparatus 400 can similarly include a fuser pressure controller 457. Likewise, the apparatus 400 can include a fuser temperature controller 458. The fuser speed controller 456 can have any of a number of possible forms such as a motor speed controller or the like, wherein the fusing device 410 can be powered by an electric motor (not shown). Each of the controllers 456, 457, 458 can have any of a number of known controller forms, including mechanical, pneumatic, electronic, and the like.

The fuser pressure controller 457 can be in signal communicable linkage with the actuator 416. In such an instance, the fuser pressure controller can be configured to control the actuator to thereby control the force with which the pressure roller 414 presses against the hot roller 412. In a like manner, the fuser temperature controller 458 can be configured to control the temperature of the fusing device 410, and more specifically, the fuser temperature controller can be configured to control the temperature of the hot roller 412.

The fuser temperature controller 458 can be configured to operate in conjunction with a fuser temperature sensor 420, or the like, which can also be included in the apparatus 400. The fuser temperature sensor 420 can be configured to detect and/or measure the temperature of a given portion of the fusing device 410. Furthermore, the fuser temperature sensor 420 can be configured to transmit a data signal to the processor 452, wherein such a data signal is indicative of the relative temperature detected and/or measured by the fuser temperature sensor. Correspondingly, the processor 452 can be configured to receive the data signal from the fuser temperature sensor 420.

In operation, the apparatus 400 can receive various data from one or more of the signal sources 541, 542, 543, 544, 545, 546 and/or also from the fuser temperature sensor 420. The processor 452 can then process and/or analyze the data thus received in accordance with the computer executable instructions 453. Responsively, the processor 542 can generate output control signals which can be transmitted to any of the fuser speed controller 456, the fuser pressure controller 457, and/or the fuser temperature controller 458. The computer executable instructions 453 can be configured to process and/or analyze the data in any of a number of possible manners including the manners discussed above with regard to FIGS. 1 through 3.

Moreover, the apparatus 400 can be operated in any of several additional methods which are described below in detail. For example, in accordance with yet another embodiment of the present invention, a method of controlling the operation of a fusing device in an electrophotographic imaging apparatus includes providing a fusing device, the operation of which is characterized by a fusing temperature, a fusing speed, and a fusing pressure.

The imaging apparatus of this method can be substantially similar to the apparatus 400 that is described above and shown in FIG. 4. Likewise, the fusing device of this method can be substantially similar to the fusing device 410 that is described above and shown in FIG. 4. The method also includes controlling the fusing speed as a function of the fusing temperature, as well as controlling the fusing pressure as a function of the fusing speed, and controlling the fusing temperature as a function of the fusing speed and the fusing pressure.

The fusing speed can also be controlled as a function of a set of parameters in addition to being controlled as a function of the fusing temperature. The set of parameters can include at least one of media moisture content, toner depth, and media caliper. Alternatively, the fusing pressure can be controlled as a function of a set of parameters in addition to being controlled as a function of fusing speed. In such an instance, the set of parameters can include at least one of media moisture content, toner depth, media caliper, and media surface roughness.

As yet a further alternative, the fusing temperature can be controlled as a function of a set of parameters in addition to being controlled as a function of the fusing speed and fusing pressure. In such an instance, the set of parameters can include at least one of media moisture content, media surface roughness, toner depth, and media caliper.

In accordance with still another embodiment of the present invention, another method of controlling the operation of a fusing device in an electrophotographic imaging apparatus includes providing a media that is characterized by a media moisture content, a media caliper, and a media surface roughness. A fusing device is also provided, the operation of which is characterized by a fusing temperature, a fusing speed, and a fusing pressure. The imaging apparatus of this method can be substantially similar to the apparatus 400 described above and shown in FIG. 4. Likewise, the fusing device of this method can be substantially similar to the fusing device described above and shown in FIG. 4.

In accordance with this method, the fusing speed is controlled as a function of a first set of parameters, wherein the first set of parameters includes at least one of media moisture content and media caliper. Furthermore, the fusing pressure is controlled as a function of a second set of parameters, wherein the second set of parameters includes at least one of media moisture content, media surface roughness, and media caliper.

Also the method includes controlling the fusing speed in accordance with a first set of parameters, wherein the first set of parameters includes at least one of media moisture content, media surface roughness, and media caliper. The fusing pressure is controlled as a function of a second set of parameters, wherein the second set of parameters includes at least one of media moisture content, media caliper, and media surface roughness. Similarly, the fusing temperature is controlled as a function of a third set of parameters, wherein the third set of parameters includes at least one of media moisture content, media surface roughness, and media caliper.

The first set of parameters can also include the fusing temperature, in addition to at least one of the media moisture content and the media caliper. Similarly, the second set of parameters can also include the fusing speed. Likewise, the third set of parameters can also include the fusing speed. Alternatively, the third set of parameters can also include the fusing pressure. As yet a further alternative, the third set of parameters can include both the fusing speed and the fusing pressure in addition to at least one of the media moisture content, media surface roughness, and the media caliper.

In accordance with still another embodiment of the present invention, yet another method of controlling a fusing device in an electrophotographic imaging apparatus includes providing an image carrying media that is characterized by a media moisture content as well as a media surface roughness and a media caliper. Also provided is a toner that is configured to be deposited onto the media in the form of an image.

The image is characterized by a toner depth. A fusing device is also provided in accordance with the method. As is mentioned above, the fusing device of this method can be substantially similar to the fusing device 410 of the imaging apparatus 400 which are described above with respect to FIG. 4.

In accordance with the method, the toner is deposited onto the media in the form of an image. Also, the fusing device is operated so that the image is substantially affixed to the media. The operation of the fusing device is characterized.by a fusing speed, a fusing temperature, and a fusing pressure.

Additionally, the fusing speed is controlled as a function of a first set of parameters, wherein the first set of parameters includes at least one of media moisture content, media caliper, toner depth, and fusing temperature. The fusing pressure is controlled as a function of a second set of parameters, wherein the second set of parameters includes at least one of media moisture content, media caliper, toner depth, media surface roughness, the fusing temperature, and the fusing speed. Also, the fusing temperature is controlled as a function of a third set of parameters, wherein the third set or parameters includes at least one of media moisture content, media surface roughness, toner depth, media caliper, the fusing speed, and the fusing pressure.

In accordance with still another embodiment of the present invention, a method of fusing an electrophotographically formed image to an image carrying media includes providing a fusing device. The fusing device can be, for example, substantially similar to the fusing device described above with respect to FIG. 4. The fusing device can be operated, wherein the operation of the fusing device is characterized by a fusing temperature, a fusing speed, and a fusing pressure.

The method also includes establishing a first relative value for each of a set of parameters selected from the group comprising ambient temperature, media caliper, media surface roughness, media moisture content, relative humidity, and toner depth. It is understood that the phrase "establishing" as used herein, is intended to include, for example, calculating, detecting and/or measuring as well as receiving data from a signal source or the like, or otherwise developing and/or defining a value for a given variable parameter. Furthermore, it is understood that the phrase "set of parameters," as used herein, is intended to mean a group of one or more parameters. Thus, a set of parameters can be only a single parameter, or alternatively, can be a plurality of parameters.

The method also includes establishing a value for the fusing temperature based on the first relative value of at least one of the set of parameters. A value for the fusing speed is also established based on the first relative value of at least one of the set of parameters. Likewise, the method includes establishing a value for the fusing pressure based on the first relative value of at least one of the set of parameters.

Additionally, a second relative value for at least one of the set of parameters is established. That is, another measurement of one or more of the set of parameters can be performed. More specifically, after one or more of the set of parameters is initially measured, additional measurements of the one or more set of parameters can be performed. Such additional measurements of the one or more set of parameters can be performed at substantially any frequency and as many times as is required. For example, given that the values of any of the set of parameters is subject to change at any time and by any amount, then it follows that relatively more frequent measurements of the one of more set of parameters can result in a relatively more accurate "picture" of the current values of the set of parameters.

Thus, for example, a first relative value for one of the set of parameters can be initially established by way of measurement. That is, more specifically, for example, a first relative value for ambient temperature can be established by taking a first measurement of the ambient temperature. Similarly, a second relative value for the parameter of ambient temperature can be established, for example, by taking a second measurement of the ambient temperature. Additional measurements for the values of one or more of the set of parameters can be similarly performed.

The method can further include adjusting the fusing temperature based on the second relative value of at least one of the set of parameters. Also, the fusing speed can be adjusted based on the second relative value of at least one of the set of parameters. Furthermore, the method can include adjusting the fusing pressure based on the second relative value of at least one of the set of parameters.

In other words, each of the fusing speed, the fusing pressure, and/or the fusing temperature can be initially established based on a first value that is established for one or more respective input parameters such as ambient temperature, media caliper, media surface roughness, media moisture content, relative humidity, and toner depth. Then, one or more of the fusing speed, the fusing pressure, and/or the fusing temperature can be adjusted or updated based on a second value established for the respective input parameters.

While the above invention has been described in language more or less specific as to structural and methodical features, it is to be understood, however, that the invention is not limited to the specific features shown and described, since the means herein disclosed comprise merely a few illustrative examples of putting the invention into effect. The invention is, therefore, claimed in any of its forms or modifications within the proper scope of the appended claims appropriately interpreted in accordance with the doctrine of equivalents.

What is claimed is:

1. A method of controlling the operation of a fusing device in an electrophotographic imaging apparatus, the method comprising:

providing a fusing device, the operation of which is characterized by a fusing temperature, a fusing speed, and a fusing pressure;

controlling the fusing speed as a function of the fusing temperature;

controlling the fusing pressure as a function of the fusing speed; and, controlling the fusing temperature as a function of the fusing speed and the fusing pressure.

2. The method of claim 1, and further comprising controlling the fusing speed as a function of a set of parameters, in addition to fusing temperature, wherein the set of parameters includes at least one parameter selected from the group comprising media moisture content, toner depth, and media caliper.

3. The method of claim 1, and further comprising controlling the fusing pressure as a function of a set of parameters, in addition to fusing speed, wherein the set of parameters includes at least one parameter selected from the group comprising media moisture content, toner depth, media caliper, and media surface roughness.

4. The method of claim 1, and further comprising controlling the fusing temperature as a function of a set of parameters, in addition to fusing speed and fusing pressure, wherein the set of parameters includes at least one parameter selected from the group comprising media moisture content, media surface roughness, toner depth, and media caliper.

5. A method of controlling the operation of a fusing device in an electrophotographic imaging apparatus, the method comprising:

providing a media that is characterized by a media moisture content, a media caliper, and a media surface roughness;

providing a fusing device, the operation of which is characterized by a fusing temperature, a fusing speed, and a fusing pressure;

controlling fusing speed as a function of a first set of parameters;

controlling fusing pressure as a function of a second set of parameters; and, controlling fusing temperature as a function of a third set of parameters, wherein:

the first set of parameters includes at least one parameter selected from the group comprising the media moisture content and the media caliper;

the second set of parameters includes at least one parameter selected from the group comprising the media moisture content, the media caliper, and the media surface roughness; and, the third set of parameters includes at least one parameter selected from the group comprising the media moisture content, media caliper, and the media surface roughness.

6. The method of claim 5, and wherein the first set of parameters also includes the fusing temperature.

7. The method of claim 5, and wherein the second set of parameters also includes the fusing speed.

8. The method of claim 5, and wherein the third set of parameters also includes the fusing speed.

9. The method of claim 5, and wherein the third set of parameters also includes the fusing pressure.

10. The method of claim 5, and wherein:

the first set of parameters also includes the fusing temperature;

the second set of parameters also includes the fusing speed; and, the third set of parameters also includes the fusing speed.

11. The method of claim 5, and wherein:

the first set of parameters also includes the fusing temperature;

the second set of parameters also includes the fusing speed; and, the third set of parameters also includes the fusing pressure.

12. The method of claim 5, and wherein:

the first set of parameters also includes the fusing temperature;

the second set of parameters also includes the fusing speed; and, the third set of parameters also includes the fusing temperature and the fusing pressure.

13. A method of controlling a fusing device in an electrophotographic imaging apparatus, the method comprising:

providing an image carrying media that is characterized by a media moisture content, a media surface roughness, and a media caliper;

providing a toner that is configured to be deposited onto the media in the form of an image, wherein the image is characterized by a toner depth;

providing a fusing device;

depositing the toner onto the media in the form of an image;

operating the fusing device, whereby the image is substantially affixed to the media, and wherein the operation of the fusing device is characterized by a fusing speed, a fusing temperature, and a fusing pressure;

controlling fusing speed as a function of a first set of parameters;

controlling fusing pressure as a function of a second set of parameters; and, controlling fusing temperature as a function of a third set of parameters, wherein:

the first set of parameters includes at least one parameter selected from the group comprising the media moisture content, the media caliper, the toner depth, and the fusing temperature;

the second set of parameters includes at least one parameter selected from the group comprising the media moisture content, the media caliper, the toner depth, the media surface roughness, the fusing temperature, and the fusing speed; and, the third set of parameters includes at least one parameter selected from the group comprising the media moisture content, the media surface roughness, the toner depth, the media caliper, the fusing speed, and the fusing pressure.

14. A method of fusing an electrophotographically formed image to an image carrying media, the method comprising:

providing a fusing device, the operation of which is characterized by a fusing temperature, a fusing speed, and a fusing pressure;

establishing a first relative value for each of a set of parameters selected from the group comprising ambient temperature, media caliper, media surface roughness, media moisture content, relative humidity, and toner depth;

establishing a value for the fusing temperature based on the first relative value of at least one of the set of parameters;

establishing a value for the fusing speed based on the first relative value of at least one of the set of parameters;

establishing a value for the fusing pressure based on the first relative value of at least one of the set of parameters; and, establishing a second relative value for at least one of the set of parameters.

15. The method of claim 14, and further comprising adjusting the value for the fusing temperature based on the second relative value of at least one of the set of parameters.

16. The method of claim 14, and further comprising adjusting the value for the fusing speed based on the second relative value of at least one of the set of parameters.

17. The method of claim 14, and further comprising adjusting the value for the fusing pressure based on the second relative value of at least one of the set of parameters.

18. The method of claim 14, and further comprising:

adjusting the fusing temperature based on the second relative value of one of the set of parameters;

adjusting the fusing speed based on the second relative value of one of the set of parameters; and, adjusting the fusing pressure based on the second relative value of one of the set of parameters.

19. An electrophotographic imaging apparatus, comprising:

an image-forming device configured to deposit toner in the form of an image onto a media sheet;

a fusing device configured to thermally fix the image to the media sheet, wherein the fusing device is configured to operate at a fusing speed, a fusing temperature, and a fusing pressure;

a signal source configured to transmit data indicative of at least one of ambient temperature, media caliper, media surface roughness, media moisture content, relative humidity, and toner depth; and, a processor configured to:

receive the data from the signal source; and, control the fusing speed, the fusing temperature, and the fusing pressure as a function of the data.

20. An electrophotographic imaging apparatus including an image forming device configured to deposit an image onto a media sheet, and a fusing device configured to thermally fix the image to the media sheet, wherein operation of the fusing device is characterized by a fusing speed, the imaging apparatus comprising:

a signal source selected from the group comprising and ambient temperature signal source, a media caliper signal source, a media surface roughness signal source, a media moisture content signal source, a relative humidity signal source, and a toner depth signal source, wherein the signal source is configured to transmit a signal that is indicative of a given parameter; and, a processor configured to receive the signal from the signal source and further configured to determine an optimum fusing speed based on the given parameter.

21. The apparatus of claim 20, and wherein operation of the fusing device is further characterized by a fusing pressure, and wherein the processor is further configured to determine an optimum fusing pressure based on the given parameter.

22. The apparatus of claim 20, and wherein the operation of the fusing device is further characterized by a fusing temperature, and wherein the processor is further configured to determine an optimum fusing temperature based on the given parameter.

23. An apparatus for use in an electrophotographic imaging process, the apparatus comprising:

a fusing device, the operation of which is characterized by a fusing speed, a fusing pressure, and a fusing temperature;

a means for controlling the fusing speed as a function of a first set of parameters;

a means for controlling the fusing pressure as a function of a second set of parameters; and, a means for controlling the fusing temperature as a function of a third set of parameters, wherein:

the first set of parameters includes at least one parameter selected from the group comprising: media moisture content; media caliper; toner depth; and fusing temperature;

the second set of parameters includes at least one parameter selected from the group comprising: media moisture content; media caliper; toner depth; media surface roughness; fusing temperature; and fusing speed; and, the third set of parameters includes at least one parameter selected from the group comprising: media moisture content; media surface roughness; toner depth; media caliper; fusing speed; and fusing pressure.

* * * * *

UNITED STATES PATENT AND TRADEMARK OFFICE

CERTIFICATE OF CORRECTION

PATENT NO. : 6,816,686 B2
DATED : November 9, 2004
INVENTOR(S) : Hooper et al.

It is certified that error appears in the above-identified patent and that said Letters Patent is hereby corrected as shown below:

Column 2,
Line 28, delete “electrophotbgraphic” and insert in lieu thereof -- electrophotographic --;

Column 5,
Line 33, delete “moist ire” and insert in lieu thereof -- moisture --;
Line 65, delete “stop” and insert in lieu thereof -- step --.

Signed and Sealed this

Twenty-first Day of June, 2005

JON W. DUDAS
*Director of the United States Patent and Trademark Office*